US010570595B2

(12) United States Patent
Sebolt

(10) Patent No.: US 10,570,595 B2
(45) Date of Patent: Feb. 25, 2020

(54) REMOVABLE HINGED STRAINER FOR A POP-UP DRAIN ASSEMBLY

(71) Applicant: Joseph A. Sebolt, North Lawrence, OH (US)

(72) Inventor: Joseph A. Sebolt, North Lawrence, OH (US)

( * ) Notice: Subject to any disclaimer, the term of this patent is extended or adjusted under 35 U.S.C. 154(b) by 0 days.

(21) Appl. No.: 16/142,147

(22) Filed: Sep. 26, 2018

(65) Prior Publication Data

US 2019/0024355 A1 Jan. 24, 2019

Related U.S. Application Data

(62) Division of application No. 15/344,630, filed on Nov. 7, 2016, now Pat. No. 10,106,967.

(60) Provisional application No. 62/253,172, filed on Nov. 10, 2015.

(51) Int. Cl.
*E03C 1/262* (2006.01)
*E03C 1/23* (2006.01)

(52) U.S. Cl.
CPC ..... *E03C 1/262* (2013.01); *E03C 1/2302* (2013.01)

(58) Field of Classification Search
CPC ..... E03C 1/262; E03C 1/2302; E03C 1/26; E03C 1/264; B01D 23/00
USPC ..... 4/287; 137/544, 140; 210/167.12, 167.1
See application file for complete search history.

(56) References Cited

U.S. PATENT DOCUMENTS 774,201 A * 11/1904 Robischon ..... E03C 1/264 4/289
1,770,639 A * 7/1930 Sanders ..... E03C 1/23 4/691
1,964,423 A * 6/1934 Blickman ..... E03C 1/23 4/287
2,075,443 A * 3/1937 Kirschner ..... E03C 1/262 4/287
2,425,964 A * 8/1947 Smith ..... A47K 1/14 4/293
2,597,399 A * 5/1952 Steele ..... F16K 5/02 4/287
2,695,411 A * 11/1954 Vinokor ..... E03C 1/264 4/292
3,411,628 A * 11/1968 Mason ..... E03C 1/26 210/163
3,813,708 A * 6/1974 Hamburg ..... A47K 1/14 4/286
4,460,462 A * 7/1984 Arneson ..... E04H 4/1236 210/163

(Continued)

*Primary Examiner* — Benjamin R Shaw
(74) *Attorney, Agent, or Firm* — Sand, Sebolt & Wernow Co., LPA

(57) ABSTRACT

A removable strainer basket, a drain assembly incorporating the basket and a method of using the same. The drain assembly includes a flange assembly mounted in an aperture in a bottom wall of the receptacle. The flange assembly defines a bore therein and a stopper is engaged with the flange assembly and is selectively movable between open and closed positions. A strainer basket is removably positionable within the bore between a part of the stopper and a part of the flange assembly. The strainer basket defines a plurality of apertures therein and through which water is able to flow when the stopper is in the open position. The strainer basket captures hair strands and other articles entrained in the draining water. The basket is selectively removable from the flange assembly for cleaning.

11 Claims, 9 Drawing Sheets

(56) References Cited

U.S. PATENT DOCUMENTS 4,826,591 A * 5/1989 Macia ..... E04H 4/1272 210/167.12
4,932,082 A * 6/1990 Ridgeway ..... E03C 1/23 4/287
5,201,340 A * 4/1993 Teepe ..... B65D 88/747 137/315.01
5,858,234 A * 1/1999 Sukun ..... B01D 29/111 210/460
5,915,847 A * 6/1999 Spears ..... E03C 1/262 4/287
6,067,669 A * 5/2000 Peterson ..... E03C 1/262 4/287
6,108,828 A * 8/2000 Cheng ..... A47K 1/14 4/286
6,592,756 B1 * 7/2003 Felix, Jr. ..... B01D 29/23 210/167.12
6,716,342 B1 * 4/2004 Tilsner ..... E04H 4/1272 210/167.12
7,563,365 B2 * 7/2009 Pellington ..... E04H 4/1272 210/167.1
8,505,125 B1 * 8/2013 Chia ..... E03C 1/264 4/289
8,857,481 B2 * 10/2014 Aviles ..... E03F 5/041 141/339
2010/0000011 A1 * 1/2010 Angarita ..... E03C 1/262 4/287
2010/0071122 A1 * 3/2010 Li ..... E03C 1/262 4/287
2013/0125299 A1 * 5/2013 Tong ..... A47K 1/14 4/295
2013/0191982 A1 * 8/2013 Booker, Jr. ..... E03C 1/2306 4/290
2014/0310862 A1 * 10/2014 Joseph ..... E03C 1/262 4/287
2015/0259892 A1 * 9/2015 Guterman ..... E03C 1/264 4/291
2015/0335201 A1 * 11/2015 Hobbs ..... A47J 37/1295 99/408
2015/0354242 A1 * 12/2015 Saccoccio ..... E04H 4/12 210/806
2016/0130793 A1 * 5/2016 Lesmeister ..... E03C 1/264 4/287
2016/0136550 A1 * 5/2016 Kennedy ..... F16K 17/12 137/550
2016/0251839 A1 * 9/2016 Ali ..... E03C 1/262 4/287
2016/0296865 A1 * 10/2016 Blanks ..... D06F 1/12
2017/0073948 A1 * 3/2017 Terrell ..... E03C 1/262
2017/0219110 A1 * 8/2017 Kennedy ..... F16K 15/023

* cited by examiner

REMOVABLE HINGED STRAINER FOR A POP-UP DRAIN ASSEMBLY

CROSS-REFERENCE TO RELATED APPLICATIONS

The present application is a divisional of U.S. patent application Ser. No. 15/344,630, filed on Nov. 7, 2016; which claims the benefit of U.S. Provisional Patent Application Ser. No. 62/253,172 filed Nov. 10, 2015. Each of the above applications are incorporated herein by reference.

BACKGROUND OF THE INVENTION

Technical Field

This invention relates generally to plumbing fixtures. More particularly, this invention is directed to plumbing fixtures used on bathtubs, sinks and basins. Specifically, this invention relates to a removable strainer basket, a drain assembly including the basket and a method of using the same; where the strainer basket is positioned within a bore of the drain assembly and a stopper is engaged with the drain assembly and is movable between an open and closed position while the strainer basket is located within the bore.

Background Information

Every bathtub, sink, basin and shower includes a drain assembly that allows water to drain therefrom and into pipes connected thereto. If only dirty water is draining from the receptacle through the drain assembly, then the typical drain assembly deals with this relatively easily. However, if the water has hair strands entrained therein, then the drain assembly and/or the pipes connected thereto may become clogged with the hair strands over time. In order to address this problem a number of different strainers have been proposed in the prior art. One of these strainers is a flexible plastic strainer that is inserted into the mouth of the drain assembly in a tub, for example. The flexible strainer may be frusto-conical in shape and define a plurality of slits or apertures therein and through which water is able to flow. Once all of the water has drained from the tub through the strainer, the strainer is lifted out of the mouth of the drain assembly and is cleaned by scraping or wiping hair strands therefrom. Once cleaned the strainer is re-inserted into the mouth of the drain assembly. In other instances, a drain strainer assembly may be engaged over the existing drain. An example of such a drain strainer assembly is fabricated and sold under the name Nufit®. The original drain flange is left intact and the new drain strainer assembly is secured to the flange by an adhesive strip or other suitable connector mechanism. The drain strainer assembly includes a flange with a pop-up plug engaged therewith and a strainer positioned between the flange and pop-up plug. The strainer is thus located above the original drain flange. The strainer includes a plurality of apertures that allow water to flow therethrough and then into the existing drain pipes. However, even though these drain strainer assemblies include a strainer to stop hair strands from flowing into the pipes, the strainers themselves are difficult to clean and over time will become clogged. If either the strainer or the drainage pipes become clogged with hair the user must use a chemical, a plumbing snake or even a plumber to unclog the drain assembly and/or the pipes connected thereto.

SUMMARY

There is a need in the art for a drain assembly which aids in preventing articles such as hair strands from flowing through the assembly and into the drainage pipes connected thereto. The drain assembly disclosed herein resolves some of these issues.

A drain assembly for a receptacle and a method of using the same is disclosed herein. The drain assembly includes a flange assembly mounted on a bottom wall of the receptacle. The flange assembly defines a bore therein that is in fluid communication with a pipe for draining water away from the receptacle. A stopper is engaged with the flange assembly and is selectively movable between open and closed positions. A strainer basket is removably positionable within the bore of the flange assembly and between a part of the stopper and a part of the flange assembly. The strainer basket defines a plurality of apertures therein and through which water is able to flow when the stopper is in the open position. The strainer basket captures hair strands and other articles entrained in the draining water. The basket is selectively removable from the flange assembly for cleaning.

In one aspect, the invention may provide a strainer basket comprising a first section and a second section; a hinge connecting the first section and the second section together, said hinge permitting the first and second sections to move relative to each other between an open position and a closed position; wherein the strainer basket is adapted to fit within a drain when in the closed position; and at least one aperture defined in one of the first section and the second section and adapted to allow water to pass therethrough.

In another aspect, the invention may provide a removable strainer basket for use with a drain assembly for a receptacle that holds water, wherein said strainer basket comprises a bottom wall; a peripheral wall extending upwardly and outwardly from the bottom wall; at least one aperture defined in one of the bottom wall and the peripheral wall; an upper rim provided at an end of the peripheral wall remote from the bottom wall; wherein at least a portion of the upper rim extends radially outwardly beyond an exterior surface of the peripheral wall; and wherein the bottom wall defines a central hole therein that extends between an upper surface of the bottom wall and a lower surface of the bottom wall; and wherein the central hole is adapted to receive a lift rod from a stopper therethrough.

In another aspect, the invention may provide a drain assembly for a receptacle; said drain assembly comprising a flange assembly adapted to be engaged in an aperture defined in a bottom wall of the receptacle, said flange assembly having a base defining a bore therein; a stopper engaged with the flange assembly and being selectively movable between an open position and a closed position; when the stopper is in the open position water is able to flow out of the receptacle through the bore of the flange assembly; and when the stopper is in the closed position water is unable to flow into the bore of the flange assembly; and a removable strainer basket positionable within the bore of the flange assembly; wherein the stopper is movable between the open position and the closed position when the strainer basket is positioned with the bore.

In another aspect, the invention may provide a method of straining hair strands or other articles from water draining out of a receptacle; the method comprising the steps of positioning a strainer basket in a bore of a flange assembly mounted in a drain aperture of the receptacle; allowing water to flow through at least one aperture defined in the strainer basket while restraining at least some of the hair strands or other articles in the strainer basket; removing the strainer basket from the bore; moving a first section of the strainer basket away from a second section of the strainer basket; and cleaning the hair strands or the other articles from the first section and the second section.

The step of removing the strainer basket may be accomplished while the stopper is engaged with the flange assembly. If this is the case then the step of removing the strainer basket further comprises pivoting a first section of the strainer basket away from a second section of the strainer basket about a hinge; and disengaging the first and second sections of the strainer basket from a lift rod extending downwardly from the stopper.

In the method, the step of positioning the strainer basket may comprise placing the upper rim of the strainer basket on a ledge extending into the bore from an interior surface of a base of the flange assembly. The step of positioning may further comprise aligning a recess on the upper rim of the strainer basket with a detent extending into the bore from the interior surface of the base; and rotating the strainer basket about an axis extending longitudinally through the bore until the recess on the upper rim is misaligned with the detent.

The method may further comprise providing a locking plate on the stopper; wherein the locking plate includes a circumferential edge that defines a recess therein; aligning the recess on the locking plate with the detent extending into the bore from the interior surface of the base; and rotating the stopper and thereby the locking plate about the axis extending longitudinally through the bore until the recess on the locking plate is misaligned with the detent.

BRIEF DESCRIPTION OF THE SEVERAL VIEWS OF THE DRAWINGS

A sample embodiment of the invention is set forth in the following description, is shown in the drawings and is particularly and distinctly pointed out and set forth in the appended claims.

Similar numbers refer to similar parts throughout the drawings.

DETAILED DESCRIPTION

Figure 2:
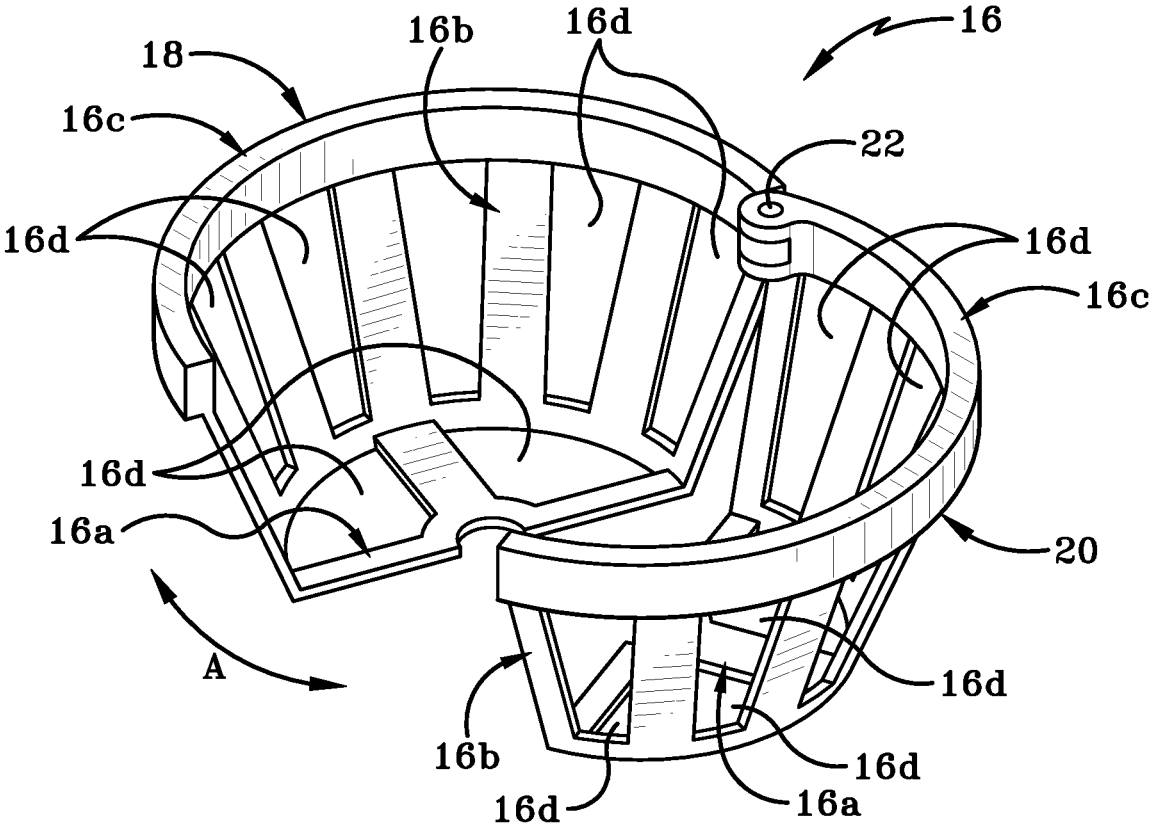
FIG. 2 is a perspective view of the strainer basket shown alone and in an open position.
Figure 3:
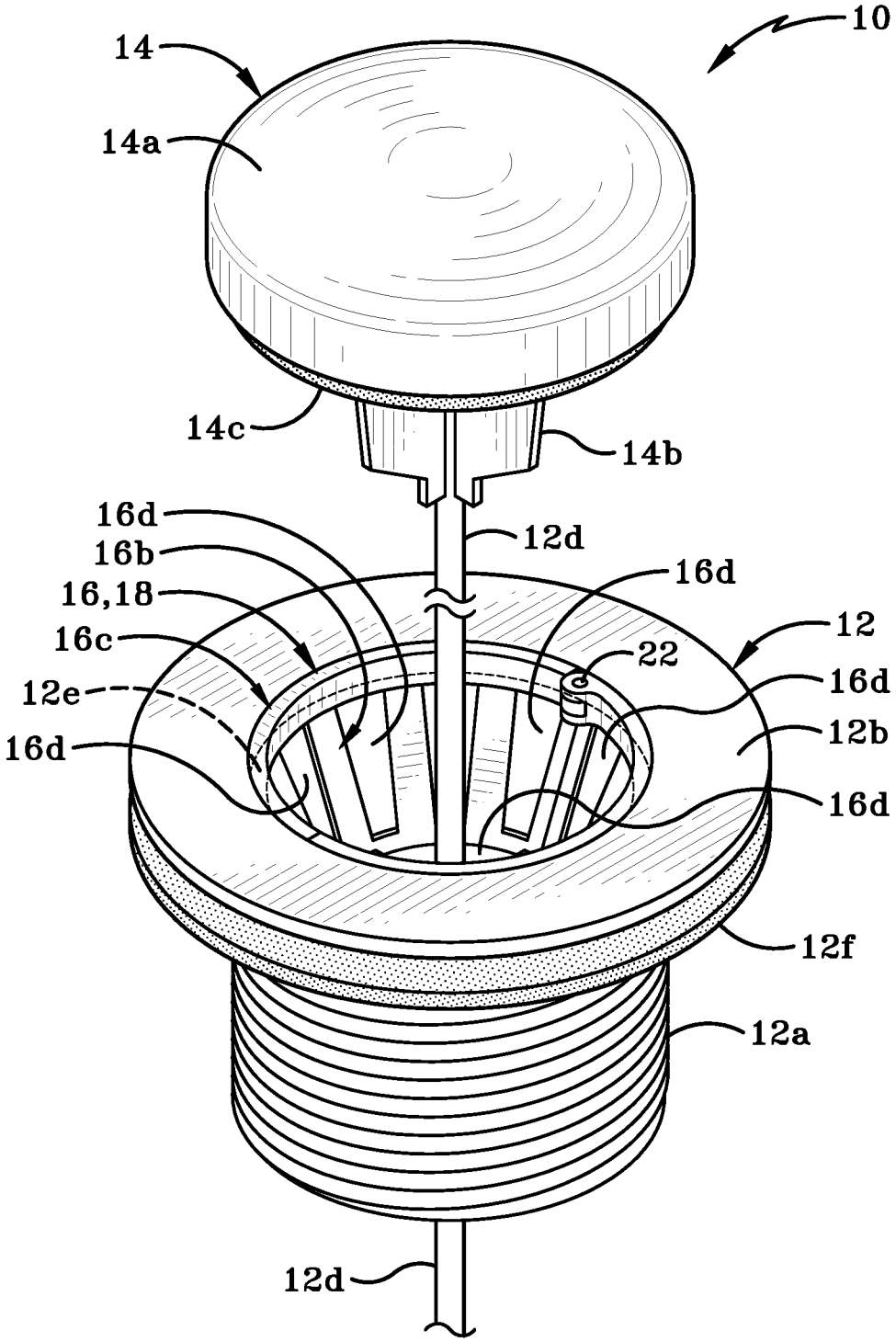
FIG. 3 is a perspective view of the strainer basket installed in the drain assembly and positioned for use.
Figure 4:
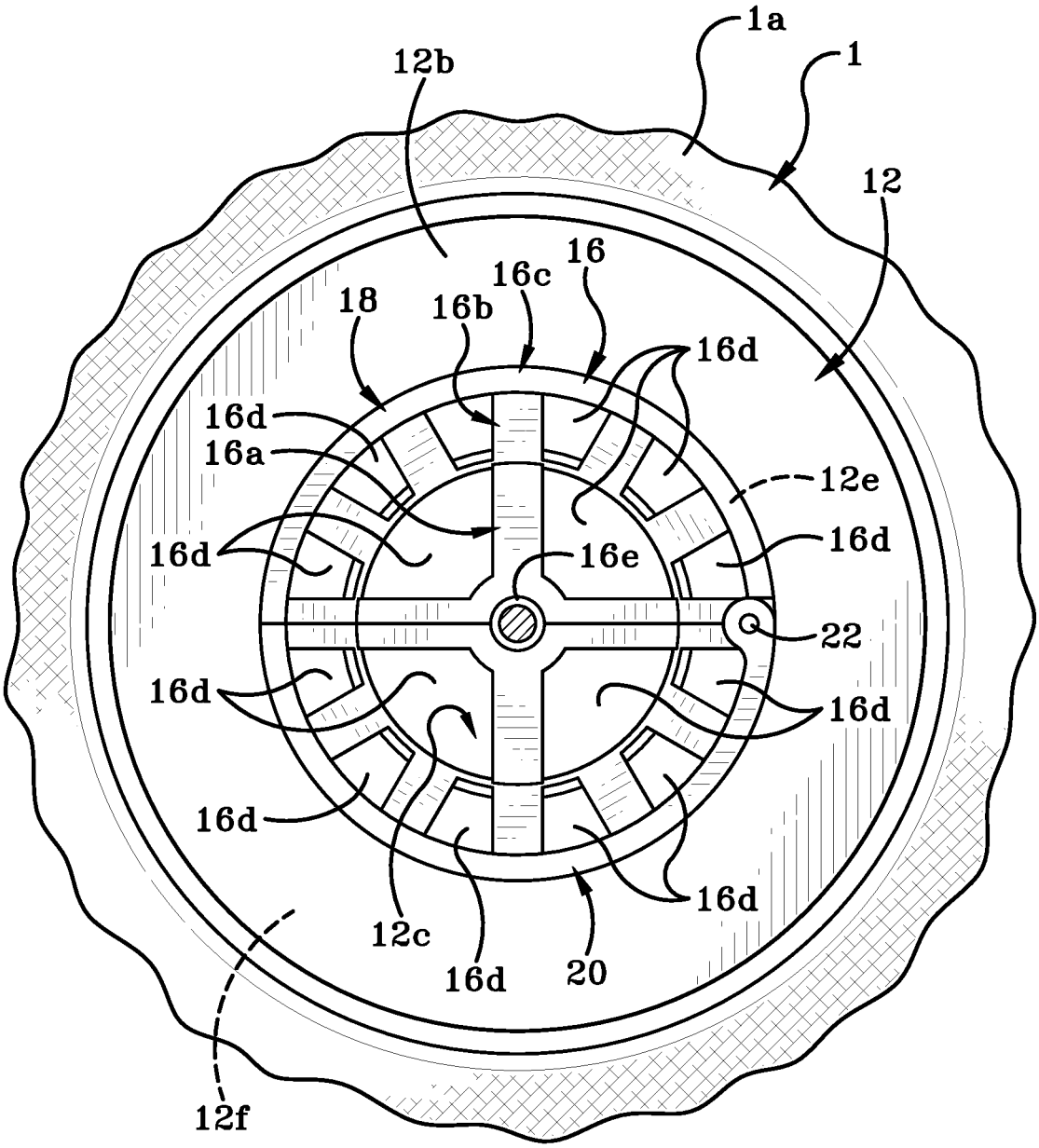
FIG. 4 is a top view of the strainer basket installed in the drain.

Referring to FIGS. 1-4 there is shown a first drain assembly in accordance with an aspect of the present invention, generally indicated at 10. FIGS. 5-7C show a second drain assembly in accordance with another aspect of the present invention, generally indicated at 110. Drain assemblies 10, 110 are designed to be installed in a drain aperture defined in a bathtub, a sink, a shower or other receptacle. The bathtub, sink, shower or other receptacle will be referred to herein by the word "receptacle" and will be indicated herein by reference number 1 (FIGS. 4 and 6). Receptacle 1 includes a bottom wall 1*a* that defines the drain aperture 1*b* (FIG. 6) therein. Drain assembly 10 or 110 is installed into drain aperture 1*b*. Part of the respective drain assembly 10, 110 may extend downwardly through aperture 1*b* for a distance below a bottom surface of bottom wall 1; another part of drain assembly 10, 110 may be flush with a top surface of bottom wall 1*a* or may extend upwardly and outwardly away from top surface of bottom wall 1*a*.

Drain assembly 10, 110 may be fabricated in a wide variety of different shapes and configurations and the assemblies 10, 110 are exemplary only.

Referring to FIGS. 1-4, drain assembly 10 may include a flange assembly 12 and a stopper (or plug) 14. Flange assembly 12 may include a tubular base 12*a* and an annular flange 12*b*. When flange assembly 12 is installed in receptacle 1, base 12*a* is inserted through aperture 1*b* in bottom wall 1*a* and is engaged with a drainage pipe (not shown). Flange 12*b* may be of a greater diameter than base 12*a* and aperture 1*a*. Thus, when base 12*a* is inserted through aperture 1*b*, flange 12*b* will come to rest on the upper surface of bottom wall 1*a*. Flange 12*b* and base 12*a* define a bore 12*c* therein. When base 12*a* is engaged with the drainage pipe, bore 12*c* of base 12*a* is placed in fluid communication with a bore of the drainage pipe. Water from receptacle 1 is able to flow through bore 12*c* and into the drainage pipe. Flange assembly 12 may further include a lift rod 12*d* that extends upwardly through bore 12*c* and an upper end thereof is secured to stopper 14. Lift rod 12*d* prevents stopper 14 from completely disengaging from flange assembly 12 and also provides a way to move stopper 14 between an open position and a closed position. Flange assembly 12 may also define an annular ledge 12*e* in an interior surface of base 12*a*. Ledge 12*e* may be located a distance downwardly from an uppermost surface of flange 12*b*. Ledge 12*e* may circumscribe bore 12*c*. The purpose of ledge 12*e* will be discussed later herein. It will be understood that while ledge 12*e* is illustrated herein as a substantially continuous annular ring that extends into bore 12*c*, ledge 12*e* may include periodic breaks and therefore comprises a plurality of ledge sections provided in substantially the same plane around the interior surface of base 12*a* that defines bore 12*c*.

Flange assembly 12 may also include an annular rubber gasket 12*f* that is positioned below a bottom surface of flange 12*b* and circumscribes base 12*a*. Gasket 12*f* is placed on the upper surface of bottom wall 1*a* when flange assembly 12 is installed in receptacle 1. Gasket 12*f* provides a seal between bottom wall 1*a* and flange assembly 12 and substantially prevents water draining from receptacle 1 to flow under flange 12*b* and around the exterior of base 12*a*. Water draining from receptacle 1 is thus forced to flow into bore 12*c* of flange assembly 12 and thereby into the drainage pipe provided below bottom wall 1*a* of receptacle 1.

Stopper 14 may include a housing 14*a* that is sized to be seated on flange 12*b* of flange assembly 12 and completely block an opening to bore 12*c*. A boss 14*b* may extend outwardly and downwardly from a lower surface of housing 14*a* and a gasket 14*c* may be provided on the lower surface of housing 14*a*. The upper end of lift rod 12*d* may be secured to or integral with boss 14*b*. A lower end of lift rod 12*d* may be engaged with appropriate connectors to a region of the drainage pipe with which base 12*a* is engaged. Stopper 14 is selectively movable via lift rod 12*d* between an open position and a closed position. In the open position, a gap is defined between a lower end of housing 14*a* and annular flange 12*b*. In this open position water is able to flow through the gap and into bore 12*c* of flange assembly 12. When stopper 14 is moved to the closed position the lower surface of housing 14*a*, in particular gasket 14*c*, is brought into contact with an upper surface of flange 12*b*. Consequently, the gap between housing 14*a* and flange 12*b* is closed and therefore water can no longer flow into bore 12*c*. Receptacle 1 therefore will no longer drain and water will be retained within receptacle 1 until stopper 14 is moved to the open position.

In accordance with aspect of the present invention, drain assembly 10 may be provided with a removable strainer basket 16. Strainer basket 16 may be configured to be engaged with flange assembly 12 without disassembling drain assembly 10 or even without disengaging stopper 14 from flange assembly 12 or disengaging lift rod 12*d* from the connectors that secure its lower end to the drainage system.

Strainer basket 16 may include a bottom wall 16*a* and a peripheral wall 16*b* which extends upwardly and outwardly from an upper surface of bottom wall 16*a*. Peripheral wall 16*b* may increase in circumference as one moves away from bottom wall 16*a* so that an upper rim 16*c* of peripheral wall 16*b* is of a greater diameter than bottom wall 16*a*. In other words, peripheral wall 16*b* may taper from upper rim 16*c* down to bottom wall 16*a*. In other instances, the circumference of peripheral wall 16*b* may be of a substantially constant width or may even taper from the bottom wall 16*a* towards upper rim 16*c*. Any shape of peripheral wall 16*b* may be utilized. Bottom wall 16*a* and peripheral wall 16*b* are shaped and sized so that strainer basket 16 is able to fit into bore 12*c* of flange assembly 12. Whatever the shape of strainer basket 16, the circumference of upper rim 16*c* is such that it is of a size and shape complementary to ledge 12*e* provided on flange assembly 12. Upper rim 16*c* is shaped and sized to be seated or rested on ledge 12*e* of flange assembly 12 when strainer basket 16 is inserted into bore 12*c* of flange assembly 12. When upper rim 16*c* of strainer basket 16 is seated on ledge 12*e*, the peripheral wall 16*b* and bottom wall 16*a* of strainer basket 16 extend downwardly for a distance below ledge 12*e*. Upper rim 16*c* may therefore extend laterally outwardly beyond an exterior surface of peripheral wall 16*b* to form a lip and this lip may then be seated on ledge 12*e*.

Bottom wall 16*a* and peripheral wall 16*b* of strainer basket 16 may each define a plurality of apertures 16*d* therein. Apertures 16*d* may be of any desired shape and size and may be provided in any one of a variety of different patterns on bottom wall 16*a* and peripheral wall 16*b*. Apertures 16*d* are provided to allow water flow out of receptacle 1 to flow therethrough. The regions of bottom wall 16*a* and peripheral wall 16*b* that bound and define apertures 16*d* will aid in preventing articles, such as hair, from flowing through apertures 16*d* and subsequently into the drainage system. Bottom wall 16*a* further defines a central hole 16*e* therein and through which lift rod 12*b* extends when strainer basket 16 is engaged with flange assembly 12.

Figure 1:
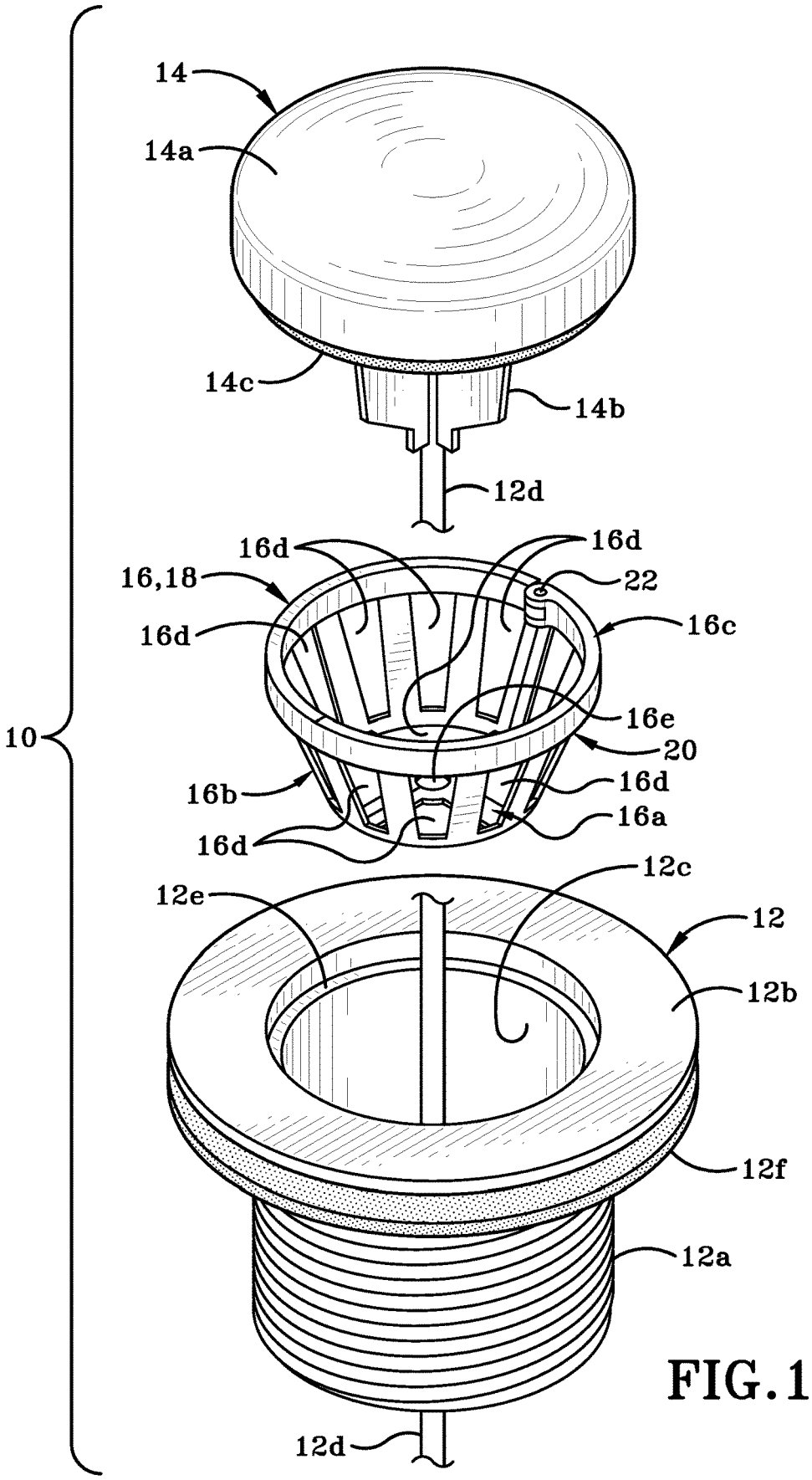
FIG. 1 is an exploded perspective view of a first drain assembly in accordance with an aspect of the present invention that includes a first embodiment of a strainer basket in accordance with an aspect of the present invention.

In some instance, as is illustrated in FIGS. 1 and 2, strainer basket 16 may be fabricated in two separate sections, identified in FIG. 2 as first section 18 and second section 20. First and second sections 18, 20 may each include a part of bottom wall 16*a*, a part of peripheral wall 16*b* and a part of upper rim 16*c*. A hinge may be provided to secure first and second sections together and to permit first and second sections to pivot between an open position (FIG. 2) and a closed position (FIG. 1) relative to each other. As illustrated herein, portions of the upper rim 16*d* on each of first section 18 and second section 20 may be shaped to receive a pivot pin 22 therethrough. The shaped regions of the upper rim on first section 18 and second section 20 and pin 22 together make up the hinge that connects first and second sections 18, 20 together. It will be understood that other types of hinges may be provided to section first and second sections 18, 20 together.

One or both of first and second sections 18, 20 may be pivoted about an axis running along pivot pin 22. First and second sections 18, 20 may be able to pivot about pivot pin 22 as indicated by arrow "A" in FIG. 2 between the open position and the closed position. Strainer basket 16 may be moved to the open position (FIG. 2) to disengage strainer basket 16 from lift rod 12*d* so as to clean out hair or other articles that have been captured in basket 16. Strainer basket 16 may be moved to the closed position (FIG. 1) to clamp basket 16 around lift rod 12*d*.

Basket 16 may be engaged with lift rod 12*d* when stopper 14 is still engaged with lift rod 12*d*. In this instance, basket 16 is moved to the open position (FIG. 2) and is moved to a position where lift rod 12*d* is able to be received in one of the semi-circular portions of central aperture 16*e*. Basket 16 is then moved to the closed position so that lift rod 12*d* is clampingly received between first section 18 and second section 20.

Alternatively, basket 16 may be engaged with lift rod 12*d* after first removing stopper 14 from the upper end of lift rod 12*d*. The upper end of lift rod 12*d* may then be inserted through central hole 16*e* in bottom 166*a* of basket 16 and stopper 14 may be re-engaged with the upper end of lift rod 12*d*. Still further, stopper 14 and lift rod 12*d* may be disengaged from receptacle 1 and a lower end of lift rod 12*d* may be inserted through hole 16*e* in basket 16 and basket 16 may be slid upwardly along lift rod 12*d* to an appropriate position. Once basket 16 is in the correct position then stopper 14 and lift rod 12*d* with the engaged basket 16 are re-engaged with flange assembly 12 and drainage pipe. These latter two methods may be used to engage basket 16 with flange assembly 12 when basket 16 is fabricated with bottom wall 16*a* and peripheral wall 16*b* being permanently fixedly engaged with each other and where basket 16 is not comprised of two separate sections 18, 20 but is a single component. The preferred device and method of use is however where basket 16 is comprised of sections 18, 20 that are hingedly engaged with each other. It will be understood that first section 18 and second section 20 do not need to be of substantially the same size as illustrated in FIG. 2. Instead, first section and second section 20 may be of different shapes and sizes and may simply be pivoted to an open position to engage basket 16 with lift rod 12*d*.

When strainer basket 16 is in position within flange assembly 12 as shown in FIG. 3, strainer basket 16 is effectively positioned at a location beneath bottom wall 1*a* of the receptacle 1 within which drain assembly 10 is mounted. This positioning makes it easier for water to flow readily into and through strainer basket 16 under the influence of gravity. The placement of stopper 14 over flange assembly 12 and therefore hiding strainer basket 16 is more aesthetically pleasing than if strainer basket 16 is visible. The fact that first and second sections 18, 20 of strainer basket 16 may be moved so that basket 16 is in the open position makes it possible for strainer basket 16 to be removed from drain assembly 10 for removal of any hair and other articles that may have been captured therein. In other words, strainer basket 16 may be disengaged from drain assembly for cleaning.

The configuration of drain assembly 10 and the location of strainer basket 16 makes it possible to move stopper 14 between the open and closed positions when strainer basket 16 is located within bore 12*c* of base 12*a*. When stopper 14 is moved to the closed position it is possible to retain water within the receptacle 1. This is not possible with some prior strainers such as the flexible plastic strainers discussed in the background of this description. These prior strainers interfere with any type of plug or stopper that could be used to stop water from flowing out of the bathtub or receptacle and these prior art strainers have to be removed to install the plug or stopper. When the plug or stopper is removed the prior art strainers have to be quickly repositioned in the mouth of the drain in order to try and capture hair and other articles in the water flowing out of the tub and into the drain. This operation is awkward and messy and may allow at least some of the hair and articles in the water to flow into the drain before the prior art strainer can be placed in position.

FIGS. 5-7C show a second drain assembly 110. Drain assembly 110 includes a flange assembly 112, a stopper 114, and a second embodiment of a strainer basket 116 in accordance with an aspect of the invention.

Figure 5:
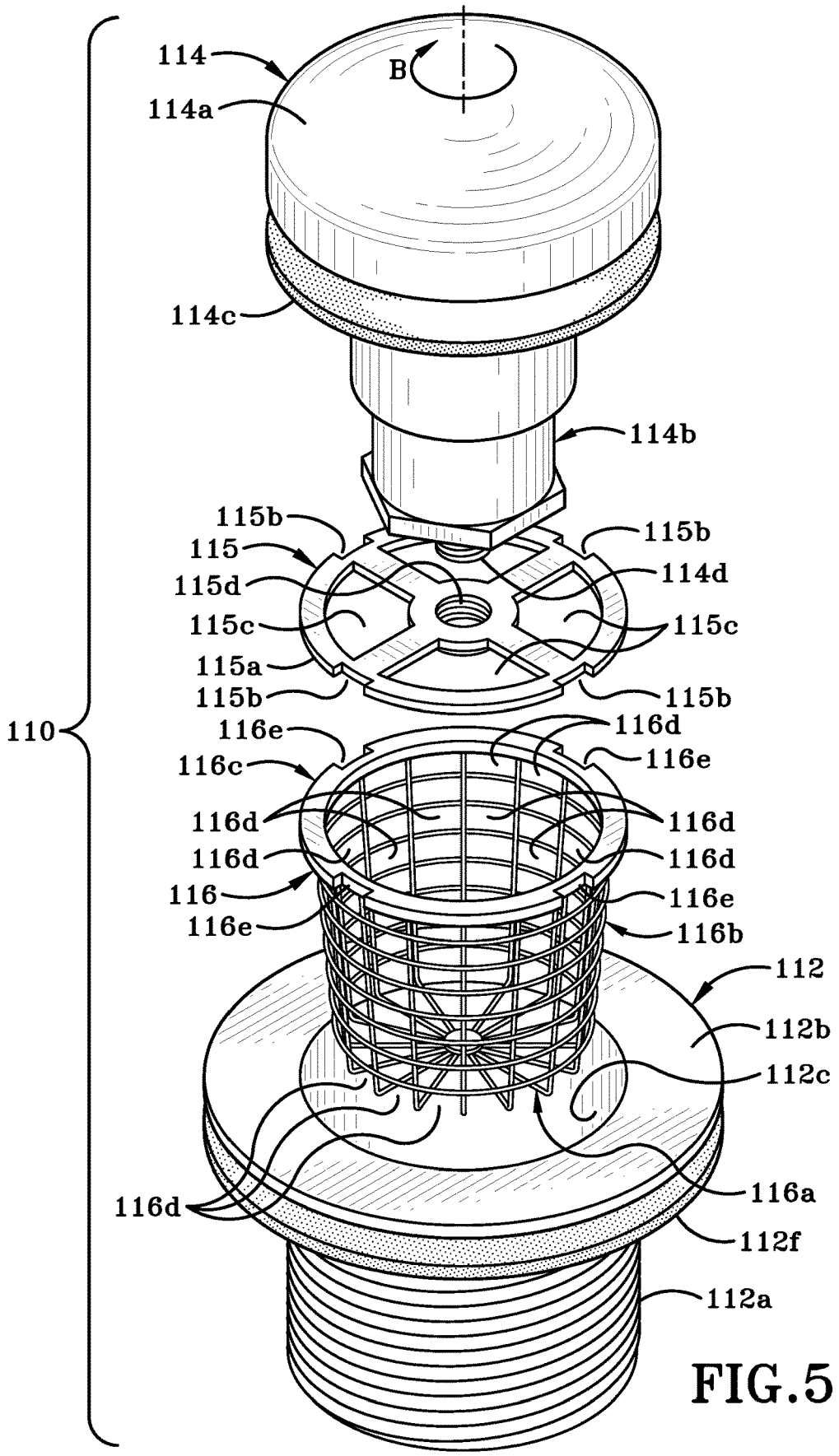
FIG. 5 is an exploded perspective view of a second drain assembly that includes a second embodiment of a strainer basket in accordance with an aspect of the present invention.
Figure 6:
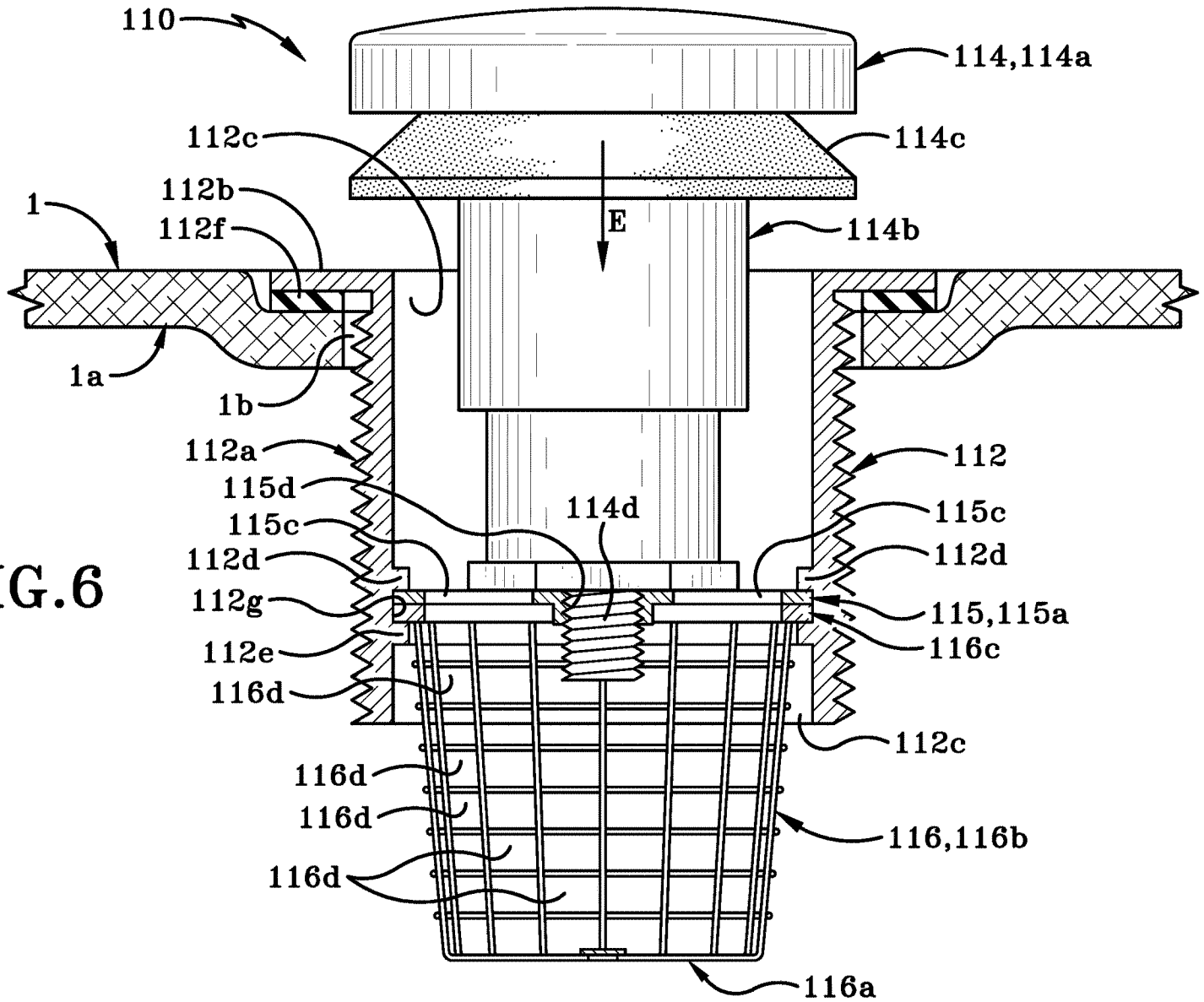
FIG. 6 is a cross-section of the drain assembly of FIG. 5 with the strainer basket in the installed position.

As shown in FIGS. 5 and 6, flange assembly 112 includes a tubular base 112*a* that is inserted through an aperture 1*b* in a bottom wall 1*a* of receptacle 1. Base 112*a* is engaged with a drainage pipe (not shown). Flange assembly 112 includes an annular flange 112*b* at one end of base 112*a*. Flange 112*b* is of a greater diameter than base 112 and a gasket 112*f* is positioned around an exterior surface of base 112*a* and adjacent a lower surface of flange 112*b*. Flange 112*b* and base 112*a* define a bore 112*c* that is placed in fluid communication with a bore of the drainage pipe when base 112*a* is engaged with the drainage pipe.

Figure 7A:
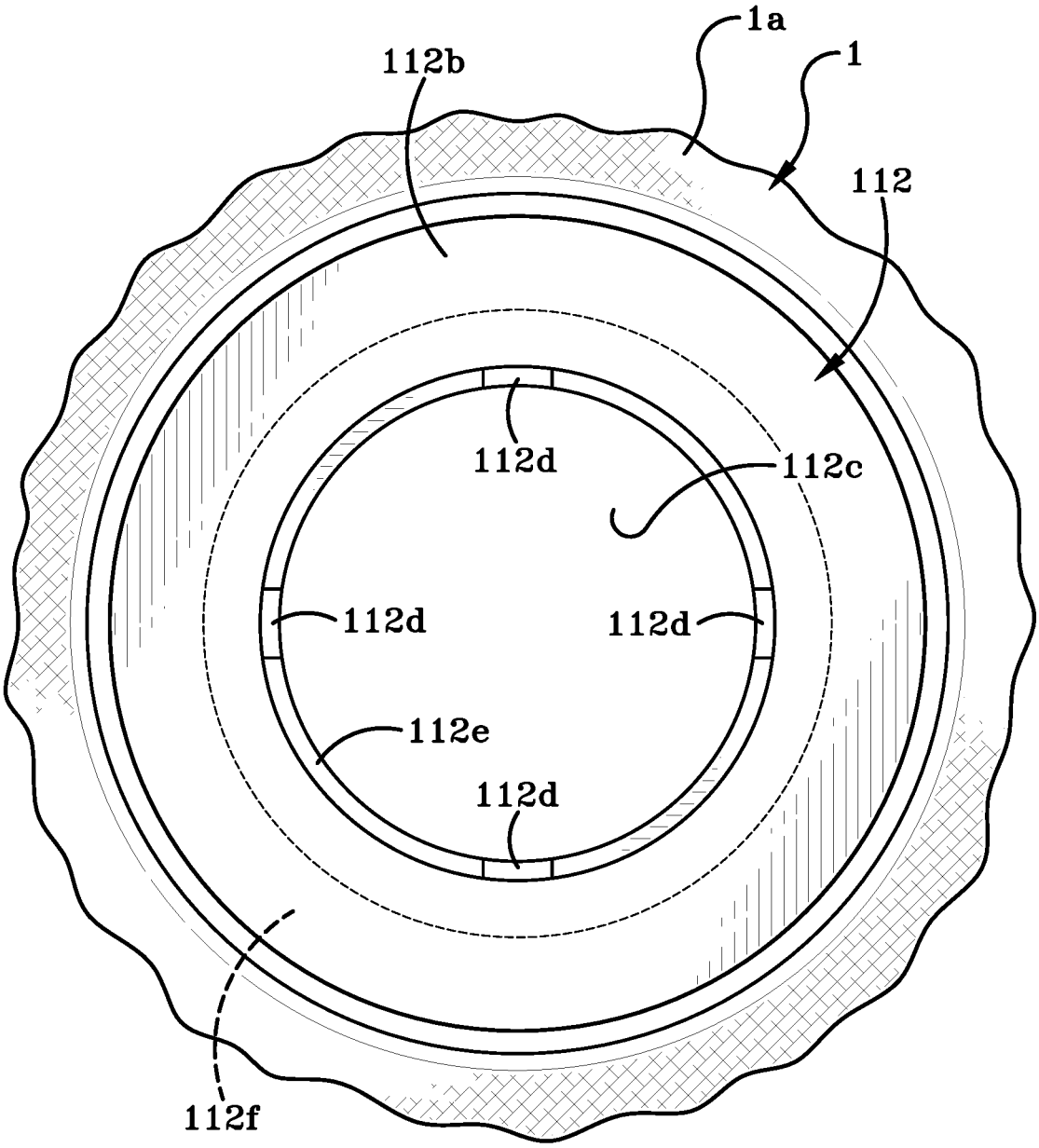
FIG. 7A is a top view of the flange assembly shown alone and installed in the tub and showing the locations for locking the strainer basket to the flange assembly.
Figure 7B:
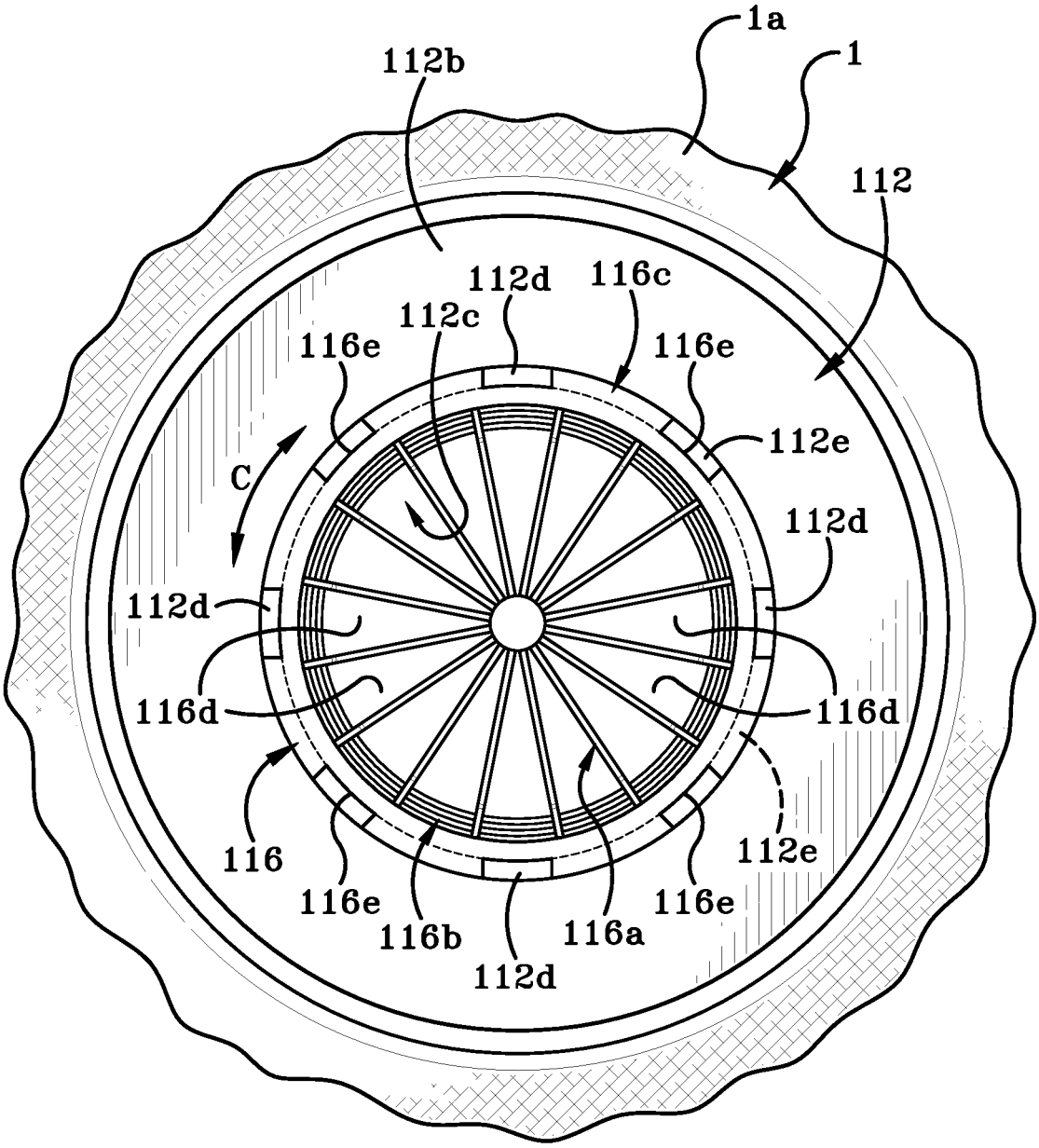
FIG. 7B is a top view of the flange assembly of FIG. 7A and further including the strainer basket engaged in the flange assembly and rotated and locked in place.
Figure 7C:
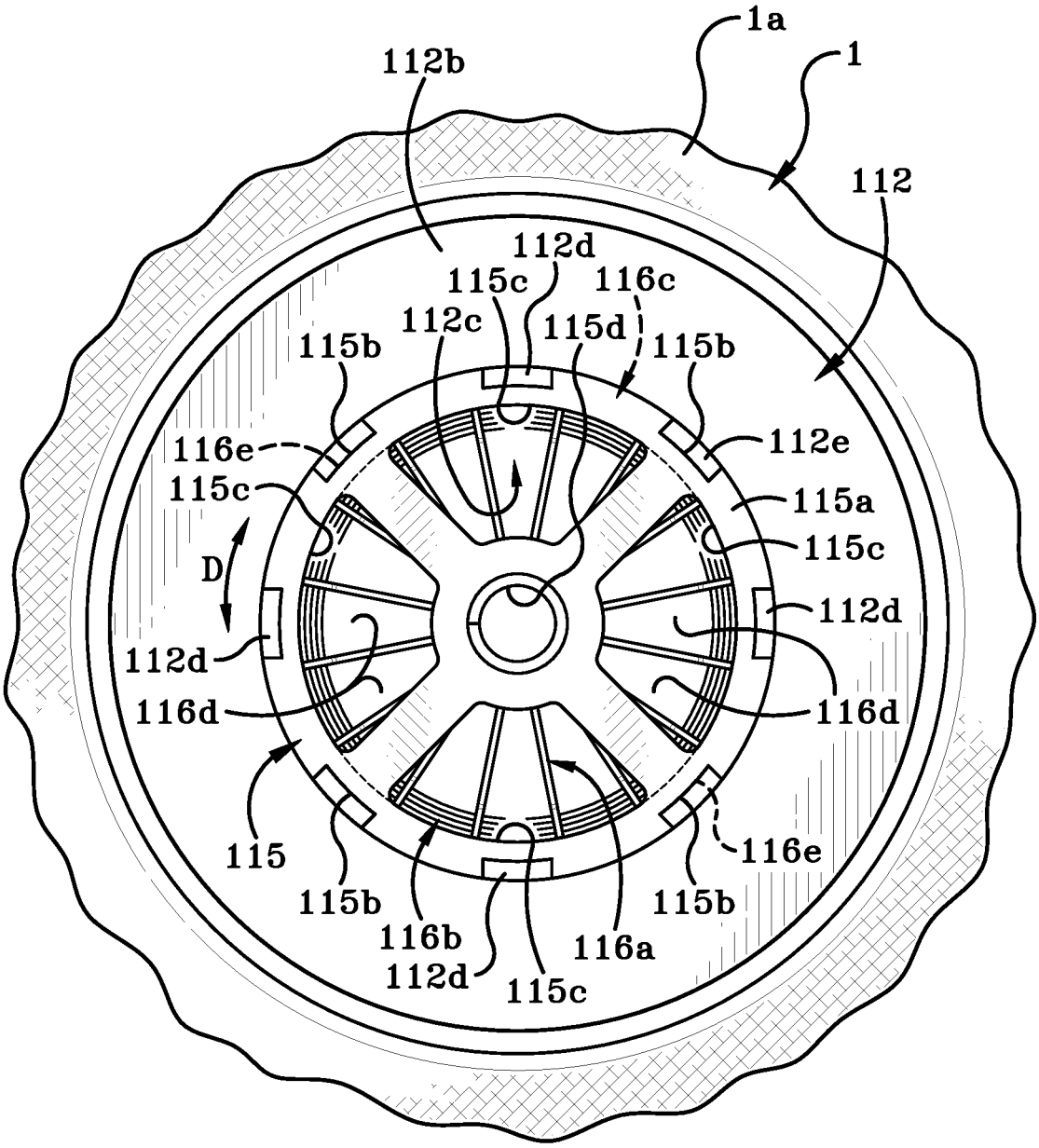
FIG. 7C is a top view of the flange assembly and strainer basket of FIG. 7B and further including the locking plate of the stopper engaged with the strainer basket.

As best seen in FIGS. 6 and 7A a plurality of detents 112*d* extends into bore 112*c* from an interior surface of base 112*a*. The detents are located at intervals around the interior circumference of base 112*a*. An annular ledge 112*e* is spaced a distance vertically below detents 112*d* and extends into bore 112*c* from the interior surface of base 112*a*. It will be understood that ledge 112*e* may be a substantially continuous annular ring that extends into bore 112*c*, ledge 112*e* may, instead include periodic breaks and therefore comprise a plurality of ledge sections provided in substantially the same plane around the interior surface of base 112*a* that defines bore 112*c*. A gap 112*g* is defined between detents 112*d* and ledge 112*e*. The purpose of detents 112*d* and ledge 112*e* will be described later herein.

Stopper 114 includes a housing 114*a* that is sized so that a least a portion of housing 114*a* will be seated on flange 112*b* of flange assembly 112 when stopper 114 is moved from an open position to a closed position. When housing 114*a* is in the closed position, an opening to bore 112*c* is closed off. Stopper 114 also includes a boss 114*b* that extends downwardly from a lower surface of housing 114*a*. Boss 114*b* is sized to be received within bore 112*c* of flange assembly 112. A seal 114*c* is provided around boss 114*b* and adjacent the lower surface of housing 114*a*. A threaded post 114*d* is provided on a bottom end of boss 114*b*.

Stopper 114 further includes a locking plate 115. Locking plate 115 is a substantially planar member that has a circumferential edge 115*a* which is complementary in shape and size to annular ledge 112*e* of flange assembly 112. A plurality of recesses 115*b* is defined in edge 115*a*. The number and placement of recesses 115*b* is complementary to the number and placement of detents 112*d* on flange assembly 112. Locking plate 115 also defines one or more apertures 115*c* that extend from an upper surface of locking plate 115 to a lower surface thereof. Apertures 115*c* are provided so as to allow water to flow therethrough when drain assembly 110 is installed in receptacle 1. Locking plate 115 further defines a central through-hole 115*d* that is internally threaded and is shaped sized to be complementary to post 114*d* on stopper 114. Locking plate 114 is threadably engaged with stopper 114.

In accordance with an aspect of the invention, strainer basket 116 is provided to be installed in drain assembly 110 between stopper 114 and flange assembly 112. Strainer basket 116 comprises a bottom wall 116*a*, a peripheral wall 116*b* extending upwardly and outwardly from bottom wall 116*a* and an upper rim 116*c*. Peripheral wall 116*b* may increase in circumference as one moves away from bottom wall 116*a* so that an upper rim 116*c* of peripheral wall 116*b* is of a greater diameter than bottom wall 116*a*. In other words, peripheral wall 116*b* may taper from upper rim 116*c* down to bottom wall 116*a*. In other instances, the circumference of peripheral wall 116*b* may be of a substantially constant width or may even taper from the bottom wall 116*a* towards upper rim 116*c*. Any shape of peripheral wall 116*b* may be utilized. Bottom wall 116*a* and peripheral wall 116*b* are shaped and sized so that strainer basket 116 is able to fit into bore 112*c* of flange assembly 112. Whatever the shape of strainer basket 116, the circumference of upper rim 116*c* is such that it is of a size and shape complementary to ledge 112*e* provided on flange assembly 112. Upper rim 116*c* is shaped and sized to be seated or rested on ledge 112*e* of flange assembly 112. Upper rim 116*c* may therefore extend laterally outwardly beyond an exterior surface of peripheral wall 116*b* to form a lip and this lip may then be seated on ledge 112*e*. When upper rim 116*c* of strainer basket 116 is seated on ledge 112*e* of flange assembly 112, the peripheral wall 116*b* and bottom wall 116*a* of strainer basket 116 will extend downwardly for a distance below ledge 112*e*.

Bottom wall 116*a* and peripheral wall 116*b* of strainer basket 116 may be comprised of a wire mesh that defines a plurality of apertures 116*d* therein. When strainer basket 116 is installed in flange assembly 112, hair strands and other articles may become trapped on this wire mesh as water flows through bore 112*c*.

Upper rim 116*c* of strainer basket 116 defines a plurality of recesses 116*e* therein. Recesses 116*e* are positioned, sized and shaped to be complementary to recesses 115*b* in locking plate 115 and to detents 112*d* on flange assembly 112. When strainer basket 116 is initially inserted into bore 112*d*, the various recesses 116*e* are aligned with detents 112*d* so that upper rim 116*c* of basket 116 may move past detents 112*d* and be seated on annular ledge 112*e* (FIG. 6) of flange assembly 112. Strainer basket 116 may then be rotated in either of a clockwise direction or an anti-clockwise direction about a longitudinal axis "B" (FIG. 5) that extends through bore 112*c* and stopper 114 so that recesses 116*e* are no longer aligned with detents 112*d*. The clockwise or anti-clockwise rotation of strainer basket 116 is indicated by arrow "C" in FIG. 7B. The rotation of strainer basket 116 locks strainer basket 116 to flange assembly 112. Basket 116 therefore cannot be lifted vertically out of bore 112*c* once basket 116 is rotated to cause misalignment between recesses 116*e* and detents 112*d*.

Stopper 114 with locking plate 115 engaged therewith is then inserted into bore 112*b*. Recesses 115*b* on locking plate 115 are aligned with detents 112*d* on flange assembly 112. Since the user will not necessarily be able to see to the detents 112*d* (either when basket 116 is installed or when stopper 114 is installed) the stopper 114 (or basket 116) may be moved downwardly into bore 112*c* until downward movement can no longer occur and then stopper 114 (or basket 116) are rotated in either of the clockwise or anticlockwise directions. When the recesses in question (either 115*b* or 116*e*) align with detents 112*d* the stopper 114 (or basket 116) will move downwardly into bore 112*c* until it comes to rest on the component below it. In the case of basket 116 that component is ledge 112*e*. In the case of stopper 114 that component is rim 116*c* of basket 116.

When locking plate 115 is engaged with stopper 114 is seated on upper rim 116*c* of strainer basket 116 then stopper 114 may be rotated in either of a clockwise direction or anticlockwise direction (arrow "D" in FIG. 7C) to move recesses 115*b* out of alignment with detents 112*d*. At this point stopper 114 is locked to flange assembly 112. Locking plate 115 and upper rim 116*d* of the strainer basket 116 are thus received and retained in gap 112*g* defined between ledge 112*e* and the one or more detents 112*d* on flange assembly 112.

When it is later desired to remove strainer basket 116 to clean the same, stopper 114 is rotated in either direction indicated by arrow "D" to bring recesses 115*b* on locking plate 115 into alignment with detents 112*d* and then stopper 114 may be lifted vertically out of bore 112*c* of flange assembly 112. Basket 116 may then be rotated in either direction indicated by arrow "C" to bring recesses 116*e* into alignment with detents 112*d* and then basket 116 may be lifted vertically out of bore 112*c*. Basket 116 may then be cleaned and returned to bore 112*c* as described previously herein. Stopper 114 with locking plate 115 may then be re-engaged with flange assembly 112 as previously described.

When strainer basket 116 and stopper 114 are engaged with flange assembly 112, stopper 114 is still able to be moved between a closed position and an open position. Stopper 114 may include a plunger-type mechanism that allows stopper 114 to be pushed downwardly in the direction of arrow "E" (FIG. 6) to close off access to bore 112*c*. When stopper 114 is moved to the closed position then water is able to be retained within receptacle 1. When stopper 114 is pushed downwardly again, the plunger-type mechanism will cause housing 114*a* of stopper 114*a* to move to the open position (FIG. 6) and then a gap opens up between a lower end of housing 114*a* and flange 112*b*. Water is then able to flow out of receptacle 1, through apertures 115*c* in locking plate 115 and then through strainer basket 116, flowing outwardly through apertures 116*d* therein and then into the drainage pipe engaged with base 112*a*. The regions of strainer basket 116 that defines apertures 116*d* will aid in preventing hair strands and other articles from moving with the water into the drainage pipe.

A method of straining hair strands and other articles from water draining out of a bathtub or shower includes the steps of installing a flange assembly 12, 112 in an aperture 1*b* defined by bottom wall 1*a* of receptacle 1, where the flange assembly 12/112 defines a bore 12*c*, 112*c* that is placed in fluid communication with a drainage pipe; inserting a strainer basket 16, 116 downwardly into the bore 12*c*, 112*c* of flange assembly 12, 112; engaging a stopper 14, 114 with flange assembly 12, 112 so that strainer basket 16, 116 is captured between stopper 14, 114 and the flange assembly 12, 112; moving the stopper 14, 114 to an open position so that a gap (FIG. 6) is created between stopper 14, 114 and flange assembly 12, 112; causing water to flow out of receptacle 1 through the gap, then through apertures 16*d*, 116*d* in strainer basket 16, 116 and subsequently through bore 12*c*, 112*c* and into the drainage pipe; and capturing hair strands or other articles entrained in the water on regions of strainer basket 16, 116 that define apertures 16*d*, 116*d*.

The method further includes periodically removing the strainer basket 16, 116 from between stopper 14, 114 and flange assembly 12, 112; cleaning hair strands and other articles from the strainer basket 16, 116; and then reinstalling strainer basket 16, 116 between stopper 14, 114 and flange assembly 12, 112.

Strainer basket 16, 116 may be comprised of any suitable material including plastic or metal materials that are suitable for coming into contact with hot or cold water. It will be understood that strainer baskets 16, 116 may be used with either type of stopper and flange assembly disclosed herein or with any of a number of other types of stopper and flange assembly.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration set out herein are an example and the invention is not limited to the exact details shown or described.

The invention claimed is:

1. A drain assembly for a receptacle; said drain assembly comprising:

a flange assembly adapted to be engaged in an aperture defined in a bottom wall of a receptacle, said flange assembly having an interior surface that bounds and defines a bore, wherein one or more detents extend outwardly from the interior surface and into the bore;

a stopper engaged with the flange assembly and being selectively movable between an open position and a closed position; when the stopper is in the open position, water is able to flow out of the receptacle through the bore, and when the stopper is in the closed position, water is unable to flow from the receptacle and into the bore;

a strainer basket removably positionable within the bore; wherein the stopper is movable between the open position and the closed position while the strainer basket is positioned within the bore;

wherein the strainer basket comprises a bottom wall; a peripheral wall extending upwardly from the bottom wall; and an upper rim provided at an end of the peripheral wall remote from the bottom wall; wherein at least a portion of the upper rim extends radially outwardly beyond an exterior surface of the peripheral wall, wherein at least one aperture is defined in one of the bottom wall and the peripheral wall and is adapted to allow water to pass therethrough; and wherein the upper rim defines one or more recesses therein that are complementary to the one or more detents extending into the bore.

2. The drain assembly as defined in claim 1, wherein the strainer basket is rotatable about an axis that extends longitudinally through the bore and wherein the rotation is operative to cause a misalignment between the one or more recesses on the strainer basket and the one or more detents on the flange assembly and the rotation is operative to lock the strainer basket to the flange assembly.

3. The drain assembly as defined in claim 1, wherein the one or more recesses are aligned with the one or more detents when the strainer basket is engaged with the flange assembly.

4. The drain assembly as defined in claim 1, wherein the stopper includes a locking plate and the locking plate defines one or more recesses therein that are complementary to the one or more detents on the flange assembly and are alignable therewith.

5. The drain assembly as defined in claim 4, wherein the locking plate is configured to be seated on the upper rim and the one or more recesses in the locking plate are selectively alignable with the one or more recesses in the upper rim of the strainer basket.

6. The drain assembly as defined in claim 1, further comprising a ledge extending from the interior surface of the flange assembly and into the bore; and wherein the one or more detents are spaced a distance vertically above the ledge such that a gap is defined between the one or more detents and the ledge.

7. The drain assembly as defined in claim 6, wherein when the strainer basket is engaged in the flange assembly the upper rim of the strainer basket is seated on the ledge and the peripheral wall and the bottom wall of the strainer basket are positioned below the ledge.

8. The drain assembly as defined in claim 7, wherein the upper rim of the strainer basket is captured in the gap between the ledge and the one or more detents.

9. The drain assembly as defined in claim 1, wherein the bottom wall of the strainer basket lacks a central hole.

10. The drain assembly as defined in claim 1, wherein the bottom wall and the peripheral wall of the strainer basket are comprised of a wire mesh.

11. The drain assembly as defined in claim 1, wherein the bottom wall and peripheral wall of the strainer basket bound and define an interior cavity that is in fluid communication with the at least one aperture; and wherein the stopper terminates one of in the interior cavity of the strainer basket and above the upper rim of the strainer basket.

* * * * *